United States Patent [19]

Singer

[11] Patent Number: 4,634,654

[45] Date of Patent: Jan. 6, 1987

[54] PHOTOGRAPHIC PRODUCTS EMPLOYING NONDIFFUSIBLE 4-ARYLAZO-1-HYDROXY-2-CARBOXY ESTER SUBSTITUTED NAPHTHOIC IMAGE DYE-PROVIDING COMPOUNDS

[75] Inventor: Stephen P. Singer, Rochester, N.Y.

[73] Assignee: Eastman Kodak Company, Rochester, N.Y.

[21] Appl. No.: 733,152

[22] Filed: May 13, 1985

[51] Int. Cl.[4] ..... G03C 1/40; G03C 5/54

[52] U.S. Cl. ..... 430/223; 430/222; 430/562

[58] Field of Search ..... 430/223, 562, 222, 226

[56] References Cited

U.S. PATENT DOCUMENTS

| | | | |
|---|---|---|---|
| 3,929,760 | 12/1975 | Landholm et al. | 430/223 |
| 3,954,476 | 5/1976 | Krutak, Sr. et al. | 430/223 |
| 4,246,414 | 1/1981 | Fujita et al. | 430/223 |
| 4,250,246 | 2/1981 | Itoh et al. | 430/223 |
| 4,255,509 | 3/1981 | Ono et al. | 430/223 |
| 4,268,624 | 5/1981 | Fujita et al. | 430/223 |
| 4,560,645 | 12/1985 | Toriuchi et al. | 430/223 |

*Primary Examiner*—Richard L. Schilling

*Attorney, Agent, or Firm*—Thomas F. Kirchoff

[57] ABSTRACT

Photographic elements and assemblages are described which employ nondiffusible 4-arylazo-1-hydroxy-2-carboxy ester substituted naphthoic image dye-providing compounds capable of releasing diffusible dye moieties which undergo substantial hue shifts at low, or acidic, pH values but which provide desired hues at neutral or basic pH values used for viewing or processing.

16 Claims, No Drawings

PHOTOGRAPHIC PRODUCTS EMPLOYING NONDIFFUSIBLE 4-ARYLAZO-1-HYDROXY-2-CARBOXY ESTER SUBSTITUTED NAPHTHOIC IMAGE DYE-PROVIDING COMPOUNDS

This invention relates to photography and more particularly to color diffusion transfer photography employing novel nondiffusible 4-arylazo-1-hydroxy-2-carboxy ester substituted naphthoic image dye-providing compounds.

Various 4-arylazo-1-hydroxy naphthoic dyes are known to be useful in color diffusion transfer photography. Many of these dyes are provided as part of redox dye-releasing (RDR) compounds employed in image transfer systems. As a result of silver halide development under alkaline conditions the desired dye is released from an RDR compound and is thereby free to diffuse to a mordant image-receiving layer.

One shortcoming of commercially used RDR compounds and associated dyes is that their spectral absorption properties are in the same wavelength regions as the respective sensitized silver halide emulsion layers with which they are associated. When, for example, a red sensitive silver halide emulsion is coated it would be highly desirable to coat a cyan RDR compound directly with the silver halide in a single layer rather than in an adjacent layer which is the customary procedure. Having the RDR compound in the same layer with the silver halide would simplify coating operations and would be more cost effective from a manufacturing viewpoint. Moreover, such a coating technique should provide sharper images, greater reactivity and shorter access times in color diffusion transfer systems since the use of fewer layers should result in shorter diffusion paths for released dyes. However, such a technique is not practical with RDR compounds containing dye moieties having the same absorption properties as the associated sensitized silver halide at pH values of 5 to 6, where silver halide emulsions are normally coated because severe speed losses are encountered during exposure due to light absorption by the RDR compounds.

The use of blocking groups on hydroxy substituents of aromatic rings of azo dye compounds in order to shift dye hues to circumvent this problem is described in the patent literature, for example in U.S. Pat. Nos. 3,929,760 and 3,954,476. Blocking shifts the absorption spectrum of an azo dye to a shorter wavelength which is then, at least in part, outside the range of absorption of the associated photosensitive silver halide. However, such blocking, even if effective to shift the absorption sufficiently outside of the range of silver halide absorption, involves the need to use a group which can be removed rapidly and completely during alkaline processing. Use of a blocking group adds at least one additional synthesis step thereby increasing the manufacturing cost of the RDR compound. Further, the addition of a blocking group increases the molecular weight of the RDR compound which then requires use of a proportionately greater weight of RDR compound in order to obtain the same amount of released dye. Higher base consumption is also required since additional alkali is needed to hydrolyze the blocking group during processing and development. Blocked dyes frequently result in loss of both activity and access time. Such dyes also exhibit tendencies to undergo complex side reactions during storage of photographic elements containing them which reactions may result in chromophore loss.

U.S. Pat. No. 4,246,414 describes the preparation and use of a substituted benzenesulfonic acid, or salt thereof, as an intermediate in the synthesis of certain redox dye releasing compounds. Among the wide variety of dye structures to which this intermediate may be attached is a class of 4-arylazo-1-hydroxy-2-substituted naphthoic dyes as disclosed in Column 13. This patent describes seven different substituents which can be present in the 2-position of the naphthalene ring, including carboxylate esters. However, as shown below by comparative data, substituents other than carboxylate esters do not provide substantial absorption shifts in the acidic or protonated form of the dye, while at the same time preserve the desired absorption range when the dye is converted to the anionic form which occurs during processing and development. Moreover, there is no disclosure in this patent of any specific dye having a carboxylate ester substituent. Neither is there any disclosure in the patent of dyes having substantially shifted absorption properties based on the pH of the environment in which the dyes are contained.

Accordingly, it is desirable to provide a nondiffusible azo image dye-providing compound suitable for use in color diffusion transfer photographic elements and assemblages which compound undergoes a substantial hue shift when protonated at low, or acidic, pH values but which exhibits desired spectral absorption at neutral or basic pH values used for viewing or processing.

One embodiment of this invention provides a photographic element comprising a support having thereon at least one photosensitive silver halide emulsion layer having associated therewith a nondiffusible 4-arylazo-1-naphthol image dye-providing compound capable of releasing a diffusible dye moiety wherein the 2-position of said naphthol compound comprises a carboxylic ester substituent and the 5-position comprises a hydroxy, a sulfonamido or a carbonamido substituent, and wherein said compound is capable of a reversible hypsochromic absorption shift from the protonated form to the anionic form thereof.

A preferred embodiment of this invention comprises a photographic element which comprises a support having thereon at least one photosensitive silver halide emulsion layer having associated therewith a nondiffusible 4-arylazo-1-naphthol image dye-providing compound or precursor thereof capable of releasing a diffusible dye moiety wherein said compound is capable of a reversible hypsochromic absorption shift from the protonated form to the anionic form thereof, said compound being represented by the structural formula:

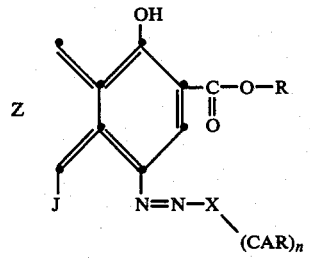

where

Z represents the carbon atoms necessary to complete an unsubstituted or a substituted naphthol ring;

R is an unsubstituted or a substituted, straight or branched chain alkyl group having from 1 to about 12 carbon atoms or an unsubstituted or a substituted aryl group having from 6 to about 15 carbon atoms;

J is —OH, $—NHSO_2R^1$ or $—NHCOR^1$;

$R^1$ is a straight or a branched chain alkyl group having from 1 to about 6 carbon atoms or an aryl group having from 6 to 10 carbon atoms;

X represents an unsubstituted or a substituted aryl dye moiety;

CAR represents a ballasted carrier moiety capable of releasing the diffusible dye moiety as a function of development of silver halide under alkaline conditions; and n is a positive integer of 1, 2 or 3.

As noted above with respect to the definition of Z, the naphthol ring can contain substituents other than J. The type of substituent which may be employed can be either electron withdrawing or electron donating, so long as such substituent has no adverse effect upon the function of the carboxylic ester substituent in the 2-position. Typical substituents which can be present on the naphthol ring, in addition to J, include further hydroxy, sulfonamido or carbonamido groups as defined above. Other substituents which can be present include halogen atoms, such as chloro or bromo; alkyl or alkoxy groups having from 1 to about 6 carbon atoms; sulfonyl represented by the formula $—SO_2R^2$, where $R^2$ can be a straight or branched chain alkyl group having from 1 to about 8 carbon atoms; a phenyl group which can be substituted; sulfamoyl represented by the formula $—SO_2NR^3R^4$; or carbamoyl represented by the formula $—CONR^3R^4$, where $R^3$ can be hydrogen or a straight or branched chain alkyl group having from 1 to about 8 carbon atoms, which can be substituted, and $R^4$ can be hydrogen, a straight or branched chain alkyl group having from 1 to about 8 carbon atoms, which can be substituted, or a phenyl or a benzyl group each of which can be substituted.

In the interest of obtaining adequate diffusion of a released 4-arylazo-1-hydroxy-2-naphthoate dye moiety, it is preferred that the alkyl groups as defined for R, $R^1$, $R^2$, $R^3$ or $R^4$ contain from 1 to about 4 carbon atoms.

Similarly, the aryl substituent defined by R, $R^1$, $R^2$ or $R^4$ is preferably a phenyl group, especially a phenyl group containing a solubilizing substituent such as for example a sulfamoyl or a carbamoyl group, as defined above.

Other substituents which can be present on alkyl groups described above for R, $R^1$, $R^2$, $R^3$ or $R^4$ include hydroxy; alkoxy having from 1 to about 4 carbon atoms; or halogen atoms such as chloro or bromo.

Other substituents which can be present on aryl groups described above for R, $R^1$, $R^2$ or $R^4$ include alkyl or alkoxy groups having from 1 to about 4 carbon atoms; hydroxy; nitro; amino, including substituted amino; or halogen atoms such as chloro or bromo.

Precursors of the dye-providing compounds of this invention can be obtained by replacing the hydrogen atom of the hydroxy group in the 1 position of the naphthol ring with a hydrolyzable group. Typical hydrolyzable groups include $$—O—\overset{O}{\overset{\|}{C}}—R^5,\ —O—\overset{O}{\overset{\|}{C}}—OR^5 \text{ or } —O—\overset{O}{\overset{\|}{C}}—N(R^5)_2$$

where $R^5$ is an alkyl group having from 1 to about 18 carbon atoms; phenyl or a phenyl group substituted with halogen or nitro. Hydrolyzable groups are well known in the art, for example from U.S. Pat. Nos. 3,929,760 and 3,954,476 noted above.

The hydrolyzable groups have the effect of shifting the absorption spectrum of the dye to shorter wavelengths. However, the amount of shifting realized by this blocking procedure is not, of itself, sufficient to accomplish the objects of this invention. With respect to the present invention, the purpose of such hydrolyzable groups would be to provide precursor compounds should such be desired for particular applications.

There is great latitude in selecting a CAR moiety which is attached to the dye-providing compounds described above. It should be noted that when the dye moiety is released from the compound, cleavage may take place in such a position that part or all of the linking group, and even part of the ballasted moiety may be transferred to the image-receiving layer along with the dye moiety. In any event, the dye nucleus mentioned above can be thought of as the "minimum" which is transferred.

CAR moieties useful in the invention are described in U.S. Pat. Nos. 3,227,550; 3,227,552; 3,628,952; and 3,844,785 (dye released by chromogenic coupling); U.S. Pat. Nos. 3,443,939 and 3,443,940 (dye released by intramolecular ring closure); U.S. Pat. Nos. 3,698,897 and 3,725,062 (dye released from hydroquinone derivatives); U.S. Pat. No. 3,728,113 (dye released from a hydroquinonylmethyl quaternary salt); U.S. Pat. Nos. 3,443,941 and 3,719,489 (silver ion induced dye release); British Patent Publication No. 2,017,950A (dye released by a dye bleach process); U.S. Pat. Nos. 4,053,312; 4,055,428; 4,149,892; 4,179,231 and 4,198,235 (dye released by oxidation and deamidation); and U.S. Pat. Nos. 3,245,789; 3,980,497; 4,139,379; Canadian Pat. No. 602,607; British Pat. Nos. 1,464,104 and 1,464,105; European Patent Publication No. 12908 and Research Disclosure No. 14447, April, 1976; (dye released by miscellaneous mechanisms), the disclosures of which are hereby incorporated by reference.

In a preferred embodiment of the invention, the ballasted carrier moiety or CAR as described above may be represented by the following formula:

(Ballast—Carrier—Link)— wherein:

(a) Ballast is an organic ballasting radical of such molecular size and configuration (e.g., simple organic groups or polymeric groups) as to render the 4-arylazo-1-naphthol image dye-providing compounds of this invention nondiffusible in said photographic elements or assemblages during development in an alkaline processing composition, (b) Carrier is an oxidizable acyclic, carbocyclic or heterocyclic moiety (see "*The Theory of the Photographic Process*", by C. E. K. Mees and T. H. James, Third Edition, 1966, pages 282 to 283), e.g., moieties containing atoms according to the following configuration:

$$a—(—C{=}C)_b—$$

wherein:

a represents the radicals OH, SH, NH— or hydrolyzable precursors thereof, and b is a positive integer of 1 or 2, and (c) Link represents a group which, upon oxidation of said Carrier moiety, is capable of being hydrolytically cleaved to release the diffusible dye moiety. For example, Link may be the following groups:

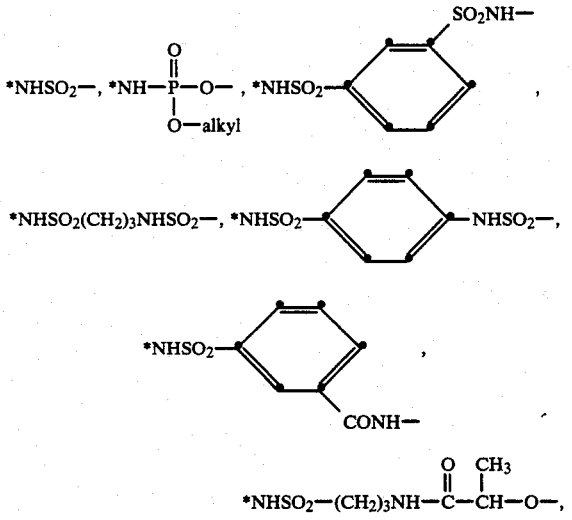

wherein * represents the position of attachment to Carrier.

The Ballast group is not critical so long as it confers nondiffusibility to the compound. Typical Ballast groups include long-chain alkyl radicals, as well as aromatic radicals of the benzene and naphthalene series linked directly or through CAR to J, R or X as shown in the above structural formula. Useful Ballast groups generally have at least 8 carbon atoms, such as substitued or unsubstituted alkyl groups of 8 to about 22 carbon atoms, a carbamoyl radical having 8 to about 30 carbon atoms, such as —CONH($CH_2$)$_4$—O—$C_6H_3(C_5H_{11})_2$ or —CON($C_{12}H_{25}$)$_2$, or a keto radical having 8 to about 30 carbon atoms, such as —CO—$C_{17}H_{35}$ or —CO—$C_6H_4$(t—$C_{12}H_{25}$).

For specific examples of Ballast-Carrier moieties useful as the CAR moiety in this invention, reference is made to the November 1976 edition of *Research Disclosure,* pages 68 through 74, and the April 1977 edition or *Research Disclosure,* pages 32 through 39, the disclosures of which are hereby incorporated by reference.

In a preferred embodiment of the invention, the ballasted carrier moiety or CAR is a group having the formula:

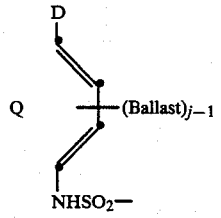

wherein:

(a) Ballast is as defined above;

(b) D is $OR^6$ or $NHR^7$ wherein $R^6$ is hydrogen or a hydrolyzable moiety, such as acetyl, mono-, di- or trichloroacetyl radicals, perfluoroacyl, pyruvyl, alkoxyacyl, nitrobenzoyl, cyanobenzoyl, sulfonyl or sulfinyl, and $R^7$ is hydrogen or a substituted or unsubstituted alkyl group of 1 to about 22 carbon atoms, such as methyl, ethyl, hydroxyethyl, propyl, butyl, secondary butyl, cyclopropyl, 4-chlorobutyl, cyclobutyl, 4-nitroamyl, hexyl, cyclohexyl, octyl, decyl, octadecyl, dodecyl, benzyl or phenethyl (when $R^7$ is an alkyl group of greater than 8 carbon atoms, it can serve as a partial or sole Ballast);

(c) Q represents at least the atoms necessary to complete a benzene or a naphthalene nucleus, or a 5 to 7 membered heterocyclic ring, such as pyrazolone or pyrimidine; and (d) j is a positive integer of 1 or 2 and is 2 when D is $OR^6$ or when $R^7$ is hydrogen or an alkyl group of less than 8 carbon atoms.

Especially good results are obtained in the above formula when D is OH, j is 2, and Q is a naphthalene nucleus.

Examples of the CAR moiety in this preferred embodiment are disclosed in U.S. Pat. Nos. 4,076,529, 3,993,638 and 3,928,312, the disclosures of which are hereby incorporated by reference, and include the following:

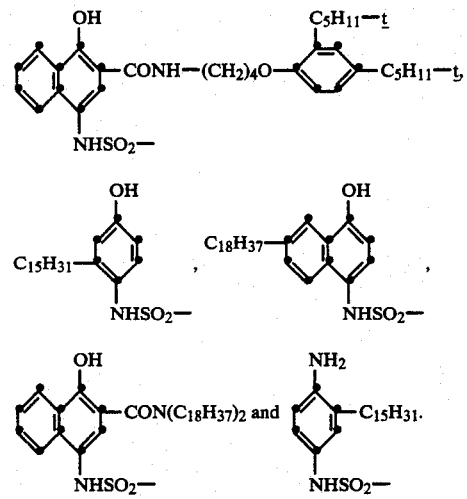

In another preferred embodiment of the invention, the ballasted carrier moiety or CAR in the above formulas is such that the diffusible azo dye is released as an inverse function of development of the silver halide emulsion layer under alkaline conditions. This is ordinarily referred to as positiveworking dye-release chemistry. In one of these embodiments, the ballasted carrier moiety or CAR in the above formulas may be a group having the formula:

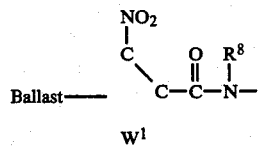

(I)

wherein:

Ballast is an organic ballasting radical of such molecular size and configuration as to render said compound nondiffusible in a photographic element during developing in an alkaline processing composition, $W^1$ represents at least the atoms necessary to complete a benzene nucleus (including various substituents thereon), and $R^8$ is an alkyl (including substituted alkyl) radical having 1 to 4 carbon atoms. Examples of the CAR moiety in this formula (I) include the following:

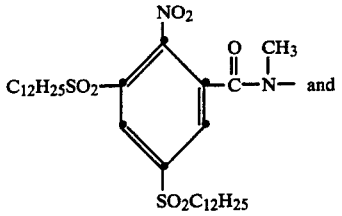

and

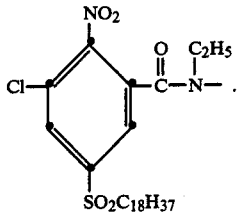

In a second embodiment of positive-working dye-release chemistry as referred to above, the ballasted carrier moiety or CAR in the above formulas may be a group having the formula:

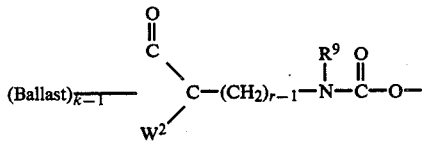

(II)

wherein:

Ballast is an organic ballasting radical of such molecular size and configuration as to render said compound nondiffusible in a photographic element during development in an alkaline processing composition, $W^2$ represents at least the atoms necessary to complete a quinone nucleus (including various substituents thereon), r is a positive integer of 1 or 2, $R^9$ is an alkyl (including substituted alkyl) radical having 1 to about 40 carbon atoms or an aryl (including substituted aryl) radical having 6 to about 40 carbon atoms, and k is a positive integer of 1 or 2 and is 2 when $R^9$ is a radical of less than 8 carbon atoms.

Examples of the CAR moiety in this formula (II) include the following:

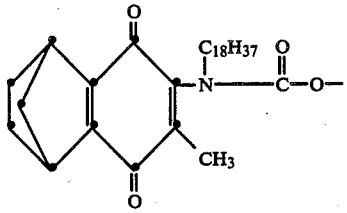

and

-continued

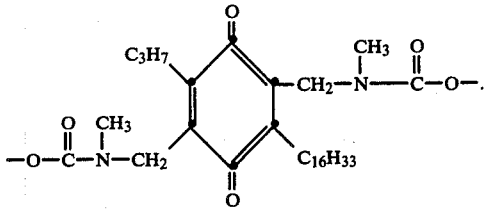

In using the compounds in Formulas I and II above, they are employed in a photographic element similar to the other nondiffusible dye-releasers previously described. Upon reduction of the compound as a function of silver halide development under alkaline conditions, the azo dye is released. In this embodiment, conventional negative-working silver halide emulsions, as well as direct-positive emulsions, can be employed. For further details concerning these particular CAR moieties, including synthesis details, reference is made to U.S. Pat. No. 4,139,379, the disclosure of which is hereby incorporated by reference.

In a third embodiment of positive-working dye-release chemistry as referred to above, the ballasted carrier moiety or CAR in the above formulas may be a group having the formula:

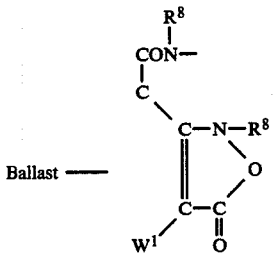

(III)

wherein:

Ballast, $W^1$ and $R^8$ are as defined for formula (I) above.

Examples of the CAR moiety in this formula (III) include the following:

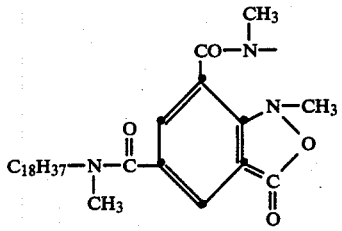

and

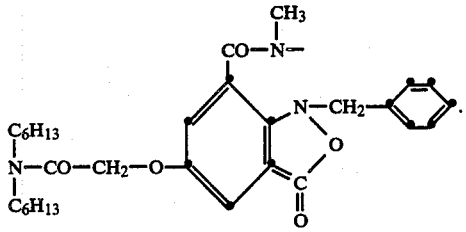

For further details concerning this particular CAR moiety, including synthesis details, reference is made to U.S. Pat. No. 4,199,354, the disclosure of which is hereby incorporated by reference.

In a fourth embodiment of positive-working dye-release chemistry as referred to above, the ballasted carrier moiety of CAR in the above formulas may be a group having the formula;

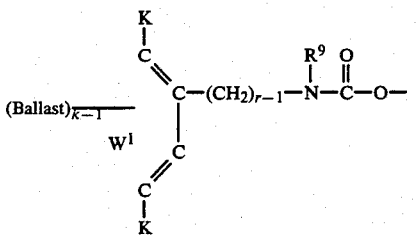

(IV)

wherein:

Ballast, $W^1$, r, $R^9$ and k are as defined above, and K is OH or a hydrolyzable precursor thereof.

Examples of the CAR moiety in this formula (IV) include the following:

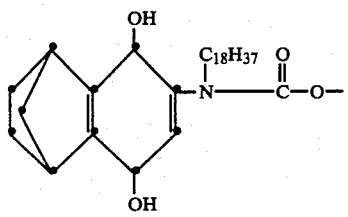

and

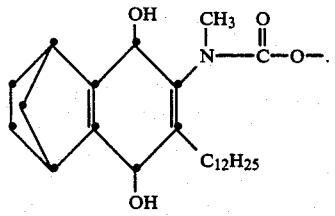

For further details concerning this particular CAR moiety, including synthesis details, reference is made to U.S. Pat. No. 3,980,497, the disclosure of which is hereby incorporated by reference.

As noted above, X represents an unsubstituted or a substituted aryl moiety which completes an azo magenta or azo cyan dye-providing compound. Such dye moieties can be any of those which are useful in the photographic art to provide image dyes. A preferred class is azoaromatic dyes in which the auxochrome is a hydroxy group.

Representative dyes that can provide the aryl dye moiety in the dyes of this invention include those of U.S. Pat. Nos. 3,230,085, 3,307,947, 3,579,334 and 3,684,513, as well as the phenylazonaphthyl dyes of U.S. Pat. Nos. 3,929,760, 3,931,144, 3,932,380, 3,932,381, 3,942,987, 3,954,476, 4,001,204 and 4,013,635; the phenylazopyrazoline dyes of U.S. Pat. No. 4,013,633; the arylazopyrazolotriazole and arylazopyridinol dyes of U.S. Pat. No. 4,142,891; the arylazo dyes of U.S. Pat. No. 4,156,609; the heterocyclylazonaphthol dyes of U.S. Pat. No. 4,207,104; the pyrimidylazopyrazole dyes of U.S. Pat. No. 4,148,641; the pyridylazonaphthol dyes of U.S. Pat. No. 4,147,544; the arylazopyridinol dyes of U.S. Pat. No. 4,148,642 and the arylazovinylol dyes of U.S. Pat. No. 4,148,643.

Dye-providing compounds of this invention are initially immobile and are rendered mobile in the presence of an alkaline processing solution as a function of silver halide development. This type of dye-providing compound is sometimes referred to as a dye-releasing compound. In such compound the monitoring group is a carrier from which the dye is released as a function of silver halide development.

Substituents on the aryl dye moiety (X) can be electron withdrawing such as cyano; sulfo; sulfonyl, including fluorosulfonyl; halogen; nitro; sulfito; sulfinyl; sulfamoyl or carbamoyl. The subsitutents can also be electron donating such as alkyl; alkoxy; or mercapto. The choice of substituent on the aryl moiety will depend in part upon the nature and type of desired dye as well as where the substituent is positioned on the ring.

Representative 4-arylazo-1-naphthol-2-carboxylic ester substituted RDR compounds useful in this invention include:

Magenta RDR Compounds

1.

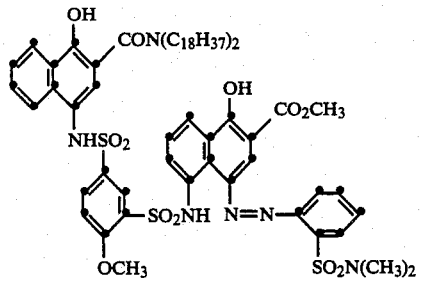

2.

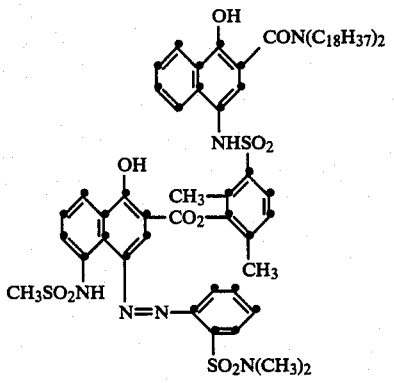

-continued
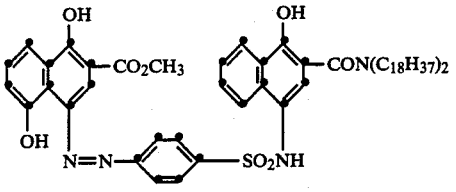
3.
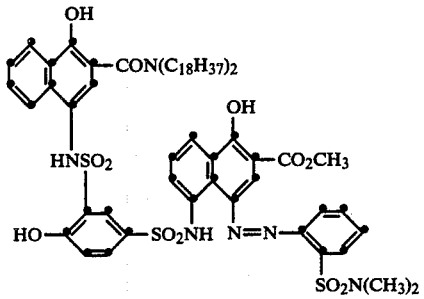
4.
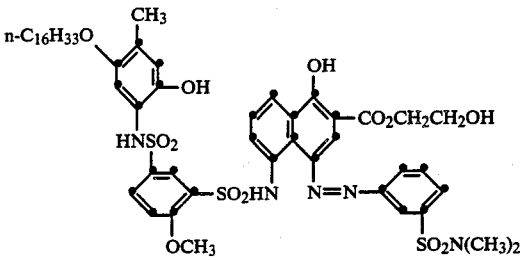
5.
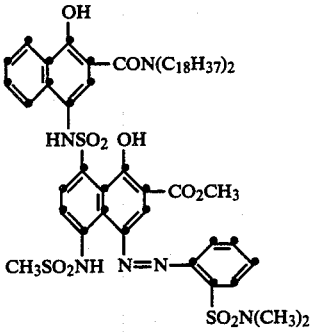
6.
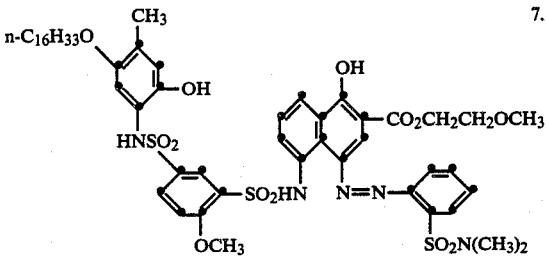
7.
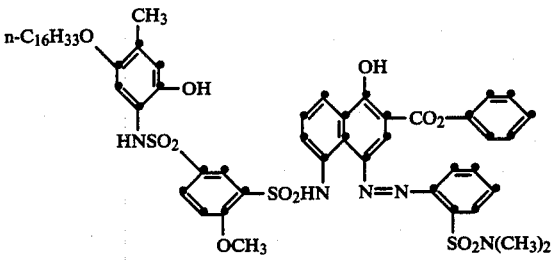
8.
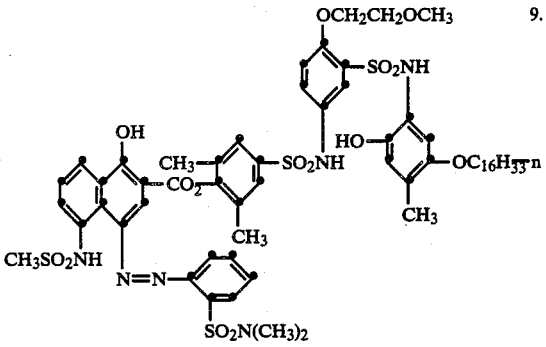
9.
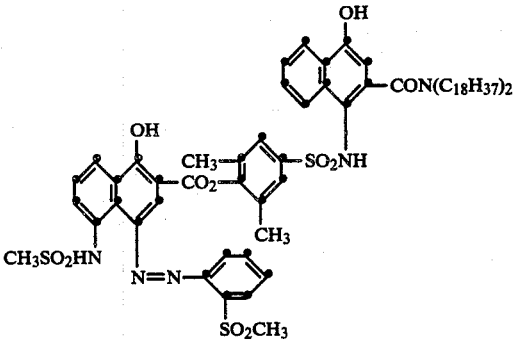
10.

-continued
11.
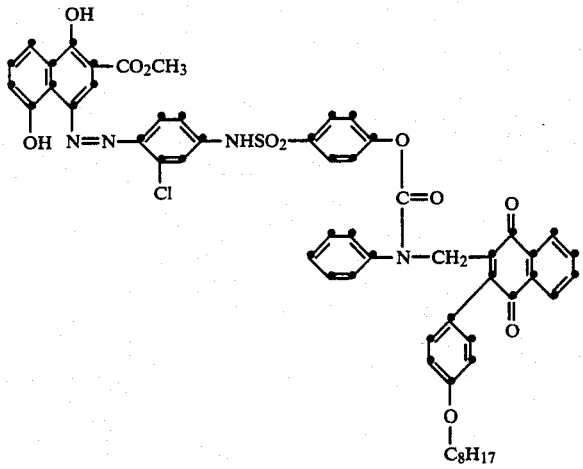
12.
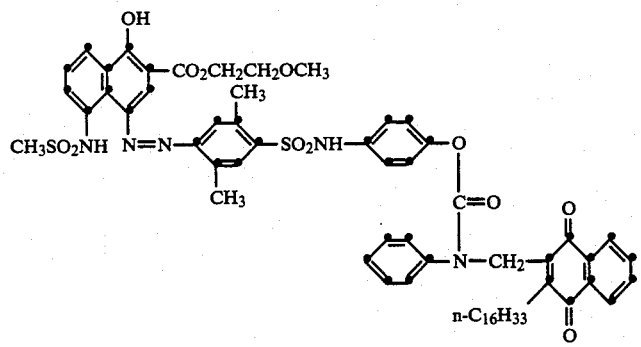
13.
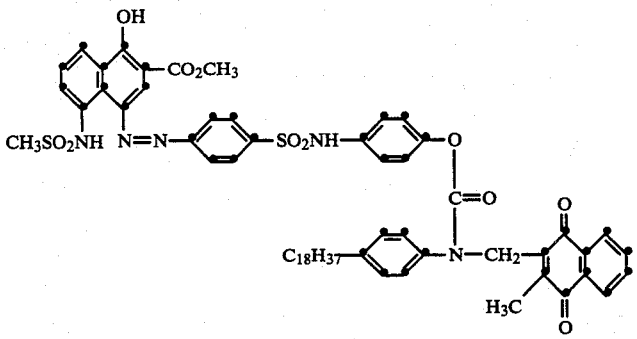
Cyan RDR Compounds
14.
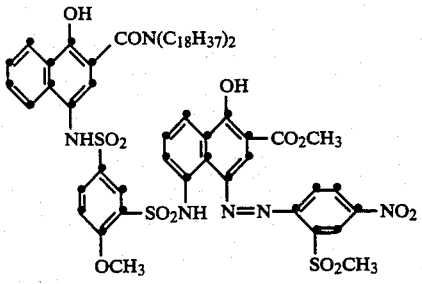
15.
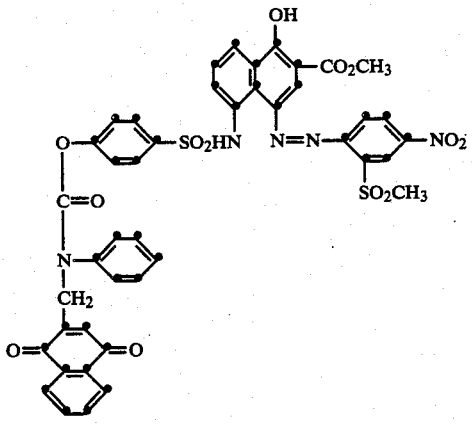

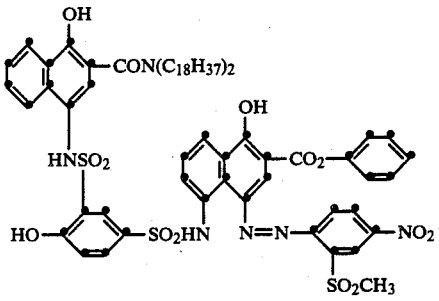

-continued

16.

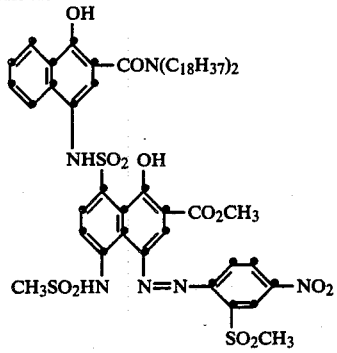

17.

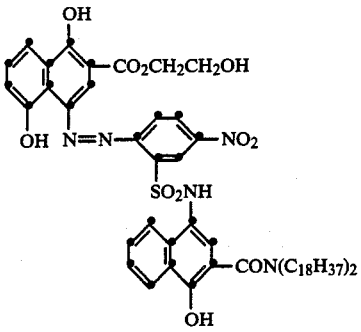

18.

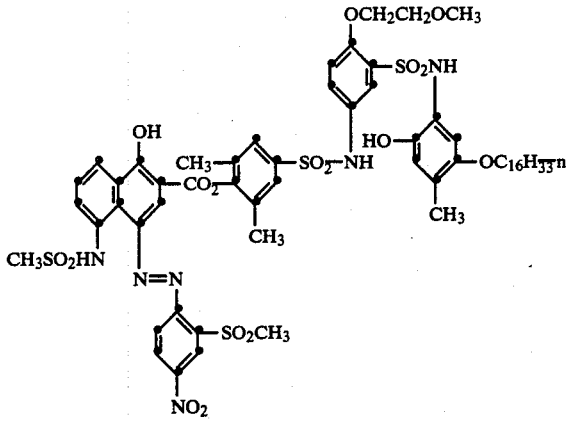

19.

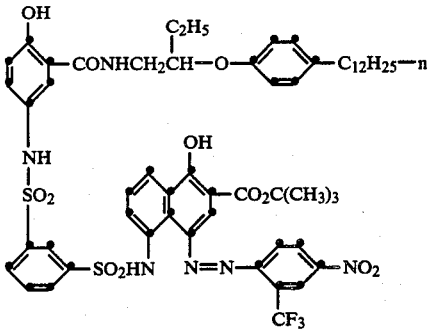

20.

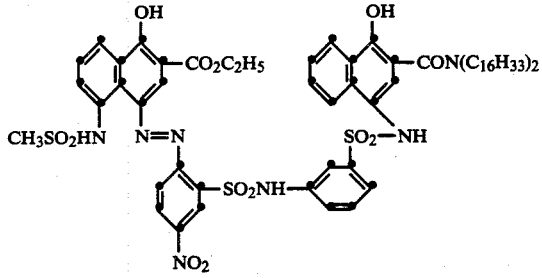

21.

Dyes released from the dye-providing compounds of this invention are suitable for image transfer applications. They have desirable hues in their anionic imaging form but in their acidic or protonated form at pH values of about 5 to 6, their absorption properties are substantially shifted to lower values. This permits their incorporation into silver halide emulsions without loss of photographic speed as a result of absorption of radiation intended solely for the photosensitive silver halide. The released dyes have good stability. They also exhibit good diffusion under conditions of color transfer usage and are compatible with known and commonly used mordants.

More active dye-providing compounds are obtained when a ballasted carrier moiety is linked through the 2-position of the 1-naphthol ring, that is, through the carboxyl ester group. To minimize direct hydrolysis of sulfamoyl substituted phenyl esters, increased steric bulk, such as that provided by 2,6-dialkyl phenyl esters, where the alkyl groups have from 1 to about 4 carbon atoms, is favored.

The photographic element described above can be treated in any manner with an alkaline processing composition to effect or initiate development. A preferred method for applying processing composition is by use of a rupturable container or pod which contains the composition. In general, the processing composition contains a developing agent, although the composition could be an alkaline solution with the developing agent being incorporated in the photographic element or cover sheet. In the latter case the alkaline solution serves to activate the incorporated developer.

A preferred embodiment of the present invention comprises a photographic element comprising a support having thereon a red-sensitive silver halide emulsion layer having associated therewith a 4-arylazo-1-hydroxy-2-carboxy ester substituted naphthoic cyan image dye-providing compound, a green-sensitive silver halide emulsion layer having associated therewith a 4-arylazo-1-hydroxy-2-carboxy ester substituted naphthoic magenta image dye-providing compound and a blue-sensitive silver halide emulsion layer having associated therewith a yellow image dye-providing compound.

A photographic assemblage in accordance with this invention comprises:

(a) a photographic element comprising a support having thereon at least one photosensitive silver halide emulsion layer having associated therewith a nondiffusible 4-arylazo-1-naphthol image dye-providing compound or precursor thereof capable of releasing a diffusible dye moiety; wherein the 2-position of said naphthol compound comprises a carboxylic ester substituent and the 5- position comprises a hydroxy, a sulfonamido or a carbonamido substituent.

(b) a dye image-receiving layer; and (c) an alkaline processing composition with means for discharging same within said assemblage;

said assemblage also comprising a silver halide developing agent.

The processing composition may be inserted into the assemblage by interjecting processing solution with communicating members similar to hypodermic syringes which are attached either to a camera or camera cartridge. The processing composition can also be applied by means of a swab or by dipping into a bath. Another method of applying processing composition in the assemblage is the liquid spreading means described in U.S. Pat. No. 4,370,407.

The assemblage itself preferably contains the alkaline processing composition and means containing same for discharge within the assemblage. There can be employed, for example, a rupturable container which is adapted to be positioned during processing so that a compressive force applied to the container by pressure-applying members, such as would be found in a camera designed for in-camera processing, will effect a discharge of the container's contents within the assemblage.

Image-receiving layers which can be employed with the 4-arylazo-1-hydroxy-2-naphthoic ester dye compounds of this invention can be any of those recognized in the art as providing the desired functions of mordanting or otherwise fixing the dye images. The choice of mordant will, at least in part, depend upon the dye to be mordanted and can be a basic polymeric mordant, such as described in U.S. Pat. Nos. 2,882,156; 3,625,694; 3,709,690; 3,898,088; 3,958,995; 3,859,096; or in the November 1976 edition of Research Disclosure, pages 80–82.

The dye image-receiving layer in the above-described assemblage is optionally located on a separate support adapted to be superposed on the photographic element after exposure thereof. Such an image-receiving element is generally disclosed in U.S. Pat. No. 3,362,819. When the means for discharging processing composition is a rupturable container, it is usually positioned in relation to the photographic element and the image-receiving layer so that a compressive force applied to the container by pressure-applying members, such as would be found in a typical camera used for in-camera processing, will effect a discharge of the container's contents between the image-receiving layer and the outermost layer of the photographic element. After processing, the dye image-receiving layer is separated from the photographic element.

The dye image-receiving layer in the above-described assemblage in another embodiment is located integrally with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer and dye images are formed as a function of development which diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container containing an alkaline processing composition and an opacifier is positioned adjacent the top layer and a transparent top sheet which has thereon a neutralizing layer and a timing layer. The film unit is placed in a camera, exposed through the transparent top sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide positive, right-reading images which are viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also preferably contains a neutralizing layer and a timing layer underneath the dye image-receiving layer.

A preferred photographic assemblage in accordance with the invention comprises:

(a) a photographic element comprising a support having thereon the following layers in sequence: a dye image-receiving layer, a stripping layer, a substantially opaque layer and a photosensitive silver halide emulsion layer having associated therewith a dye image-providing compound as described above;

(b) a transparent cover sheet superposed over the silver halide emulsion layer; and (c) an opaque alkaline processing composition and means containing same for discharge, during processing, between the cover sheet and the photosensitive element.

Any material may be employed as the stripping layer in the photographic assemblage described above provided it will perform the desired function of cleanly stripping. Such materials are disclosed, for example in U.S. Pat. Nos. 3,220,835; 3,730,718 and 3,820,999 and include gum arabic, sodium alginate, pectin, polyvinyl alcohol and hydroxyethyl cellulose. Hydroxyethyl cellulose is preferably employed as the stripping layer.

The stripping layer materials employed in the assemblage described above can be employed in any amount which is effective for the intended purpose. Good results are obtained at a concentration of from about 5 to about 2000 mg/m$^2$ of element. The particular amount to be employed will vary depending on the particular stripping layer material employed and the nature of the other layers of the diffusion transfer element.

The photographic element or assemblage of the present invention can be used to produce positive images in single- or multicolors. In a three-color system, each silver halide emulsion layer will have associated therewith a dye image-providing compound which releases a dye as described above.

The concentration of image dye-providing compound that is employed in the present invention may be varied over a wide range, depending upon the particular compound employed and the results which are desired. For example, a dye-providing compound of the present invention may be coated in a layer, preferably a silver halide emulsion layer, by using a coating solution containing between about 0.5 and about 8 percent by weight of the compound distributed in a hydrophilic film-forming natural material or synthetic polymer, such as gelatin, polyvinyl alcohol, etc. which is adapted to be permeated by aqueous alkaline processing composition.

Depending upon which CAR is used in the present invention, a variety of silver halide developing agents or electron transfer agents (ETA's) are useful. In certain embodiments of the invention, any ETA can be employed as long as it cross-oxidizes with the dye-providing compounds described herein. The ETA may also be incorporated in the photosensitive element to be activated by the alkaline processing composition. Specific examples of ETA's useful in this invention include hydroquinone compounds, catechol compounds, and 3-pyrazolidinone compounds as disclosed in column 16 of U.S. Pat. No. 4,358,527. A combination of different ETA's, such as those disclosed in U.S. Pat. No. 3,039,869, can also be employed. These ETA's are employed in the liquid processing composition or contained, at least in part, in any layer or layers of the photographic element or assemblage to be activated by the alkaline processing composition, such as in a silver halide emulsion layer, a separate dye image-providing compound layer, an interlayer or an image-receiving layer.

In a preferred embodiment of the invention, the silver halide developer or ETA employed becomes oxidized upon development and reduces silver halide to silver metal. The oxidized developer then cross-oxidizes the dye-providing compound. The product of cross-oxidation then undergoes alkaline hydrolysis, thus releasing an imagewise distribution of diffusible azo dye which then diffuses to the receiving layer to provide the dye image.

In using the dye-providing compounds according to the invention which produce diffusible dye images as a function of development, either conventional negative-working or direct-positive silver halide emulsions are employed. If the silver halide emulsion employed is a direct-positive silver halide emulsion, such as an internal-image emulsion designed for use in the internal image reversal process or a fogged, direct-positive emulsion such as a solarizing emulsion, which is developable in unexposed areas, a positive image can be obtained in certain embodiments on the dye image-receiving layer. After exposure alkaline processing composition permeates the various layers to initiate development of the exposed photosensitive silver halide emulsion layers. Developing agent present in the assemblage develops each of the silver halide emulsion layers in the unexposed areas (since the silver halide emulsions are direct-positive types), thus causing the developing agent to become oxidized imagewise corresponding to the unexposed areas of the direct-positive silver halide emulsion layers. The oxidized developing agent then crossoxidizes the dye-providing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the assemblage lowers the pH to stabilize the image.

Internal-image silver halide emulsions useful in this invention are described more fully in the November 1976 edition of *Research Disclosure,* pages 76 through 79, the disclosure of which is hereby incorporated by reference.

The various silver halide emulsion layers of a color film assemblage employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 3,653,732; 2,723,051; 3,056,492; 3,056,491 and 3,152,515. Such containers usually comprise a rectangular sheet of fluid-and air-impervious material folded longitudinally upon itself to form two walls which are sealed to one another along their longitudinal and end margins to form a cavity in which processing composition is contained.

Except where noted otherwise, the silver halide emulsion layers employed in the invention comprise photosensitive silver halide dispersed in gelatin along with the dye-providing compounds.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention as long as the desired function of mordanting or otherwise fixing the dye images is obtained. The particular material chosen will depend upon the dye to be mordanted. Suitable materials are disclosed on pages 80 through 82 of the November 1976 edition of *Research Disclosure,* the disclosure of which is hereby incorporated by reference.

Use of a neutralizing material in photographic elements of this invention will usually increase the stability of the transferred image since it will effect a reduction in the pH of the image layer from about 13 or 14 to at least 11, and preferably 5 to 8, within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November 1976 edition of *Research Disclosure,* the disclosure of which is hereby incorporated by reference.

The alkaline solution-permeable, substantially opaque, light-reflective layer employed in certain embodiments of photographic assemblages used in this invention is described more fully in the November 1976 edition of *Research Disclosure,* page 82, the disclosure of which is hereby incorporated by reference.

The supports for the photographic elements used in this invention can be any material as long as it does not deleteriously affect photographic properties and is dimensionally stable. Typical flexible sheet materials are described on page 85 of the November 1976 edition of *Research Disclosure,* the disclosure of which is hereby incorporated by reference. The supports may be either opaque for obtaining a reflection print or clear or semi-translucent for obtaining a transparency. If transparencies are obtained, they may be viewed through the support side or the opposite side depending upon the "viewing" required.

While the invention has been described with reference to layers of silver halide emulsions and dye image-providing compounds, dotwise coating, such as would be obtained using a gravure printing technique, could also be employed. In this technique, small dots of blue-, green-, and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. Pat. No. 4,362,806, issued Dec. 7, 1982.

The silver halide emulsions useful in this invention, both negative-working and direct-positive ones, are well known to those skilled in the art and are described in *Research Disclosure,* Volume 176, December 1978, Item No. 17643, pages 22 and 23, "Emulsion preparation and types" they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photograhic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers such as gelatin in an alkaline medium, in the photographic elements of the invention and preferably when processed in a medium having a pH of 11 or greater. The same meaning is to be attached to the term "immobile". The term "diffusible" as used herein has the converse meaning and denotes materials having the property of diffusing effectively through the colloid layers of the photographic elements in an alkaline medium in the presence of "nondiffusing" materials. "Mobile" has the same meaning.

The term "associated therewith" as used herein is intended to mean that the materials can be in either the same or different layers so long as the materials are accessible to one another.

The following examples further illustrate this invention. Unless otherwise indicated all parts, percents and ratios are by weight.

SYNTHESIS 1

This example describes the preparation of RDR Compound No. 1, a magenta sulfonamidonaphthol redox dye-providing compound derived from a methyl 4-arylazo-1-hydroxy-2-naphthoate dye linked to the carrier through a 5-sulfonamido group. A schematic representation of the reactions involved is shown below:

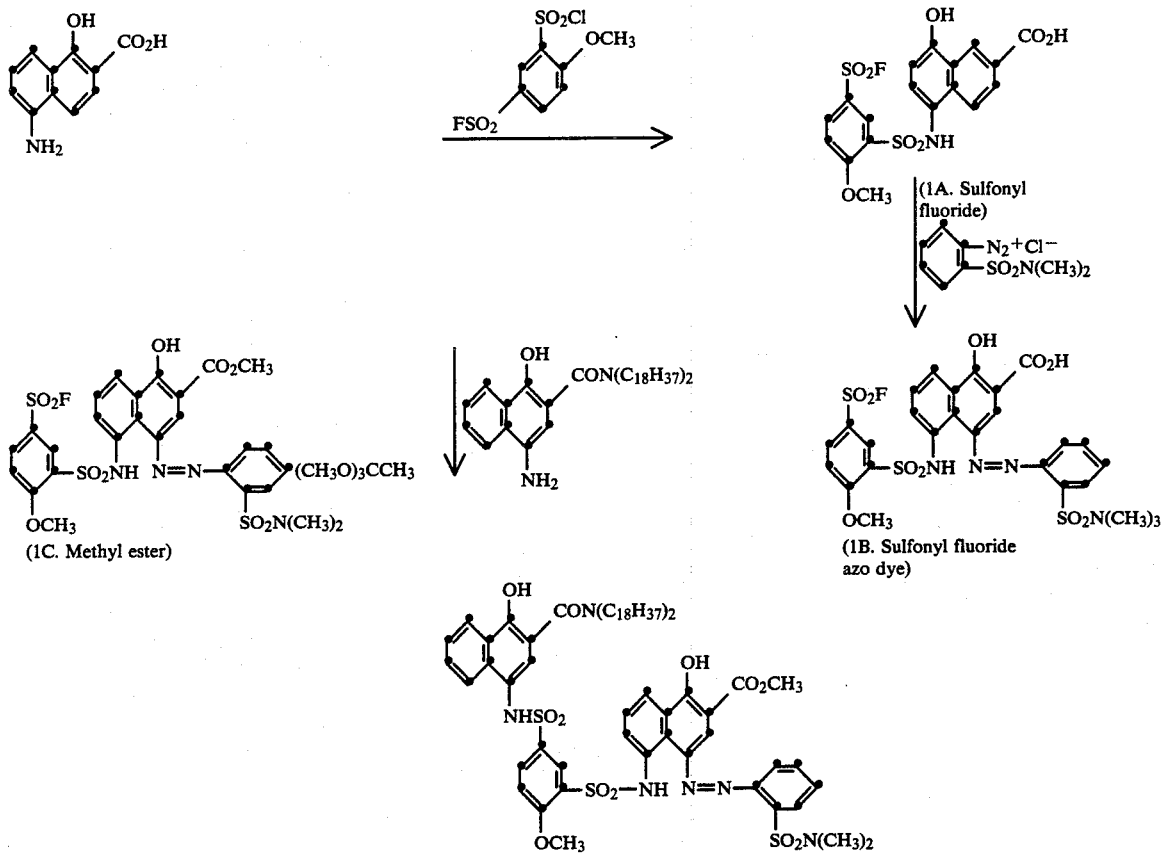

Synthesis of the sulfonyl fluoride 1A

A mixture of 5-amino-1-hydroxy-2-naphthoic acid (86 g, 420 mmoles), 460 ml tetrahydrofuran, and 86 ml water were stirred under nitrogen for 15 minutes at room temperature. N,N-Dimethylaniline (61 g, 500 mmoles) was then added followed by a solution of 5-fluorosulfonyl-2-methoxy-benzenesulfonyl chloride (146 g, 510 mmole) in 400 ml tetrahydrofuran. The mixture was stirred for 24 hours at 25° C. and then refluxed for 2 hours. After cooling to 40° C., two portions of decolorizing carbon were added. After cooling to room temperature, the mixture was filtered. The filtrate was then poured with continuous stirring into a mixture of 43 ml concentrated (36%) hydrochloric acid in 2060 ml of water. The resulting suspended precipitate was stirred overnight, filtered, washed well with water, and dried in a vacuum over at 60° C. The yield was 187 g (95 percent) of 1A.

Diazotization and coupling to form the azo dye 1B

A first solution of compound 1A (20 g. 44 mmole) in 200 ml tetrahydrofuran, 100 ml methanol, and 50 ml pyridine was cooled to 5° C. A second solution of 2-amino-N,N-dimethylbenzenesulfonamide (14 g, 70 mmole) in 100 ml methanol, 20 ml water, and 5 ml concentrated (36%) hydrochloric acid was diazotized at <5° C. with sodium nitrite (4.9 g, 71 mmole) dissolved in 15 ml water and then added dropwise with stirring to the first solution to effect coupling. After one hour, the reaction mixture was poured onto ice and concentrated (36%) hydrochloric acid. The resulting orange solid was recovered by filtration, dissolved in 60 ml ethyl acetate and dried over anhydrous magnesium sulfate. The resulting solid 1B, obtained by filtering and removal of solvent, was used for the preparation of the methyl ester 1C.

Esterification to form the methyl ester 1C

The azo dye 1B obtained above was dissolved in 350 ml anhydrous acetonitrile containing trimethyl orthoacetate (30 ml) and refluxed for 15 minutes. The hot solution was filtered and washed with diethyl ether. The yield of dye sulfonyl fluoride methyl ester, 1C, was 20.8 g (70 percent).

Preparation of the redox dye releasing Compound No. 1

A mixture of methyl ester 1C (20 g, 30 mmole), 4-amino-1-hydroxy-N,N-dioctadecyl-2-naphthamide (24 g, 34 mmole) and sodium bicarbonate (5.3 g, 63 mmole) in 300 ml anhydrous dimethyl sulfoxide was heated at 110° C. with stirring under nitrogen for 90 minutes. The hot solution was poured onto ice and concentrated (36%) hydrochloric acid. The orange solid was filtered off and purified by silica gel column chromatography using selected acetone/dichloromethane mixtures. The yield of solid redox dye releasing Compound No. 1 was 28 g (69 percent).

SYNTHESIS 2

This example describes the preparation of RDR Compound No. 2, a magenta sulfonamidonaphthol redox dye releasing compound derived from a 4-arylazo-5-methanesulfonamido-1-naphthol dye linked to the carrier through a 2-carboxylate group. A schematic representation of the reactions involved is shown below:

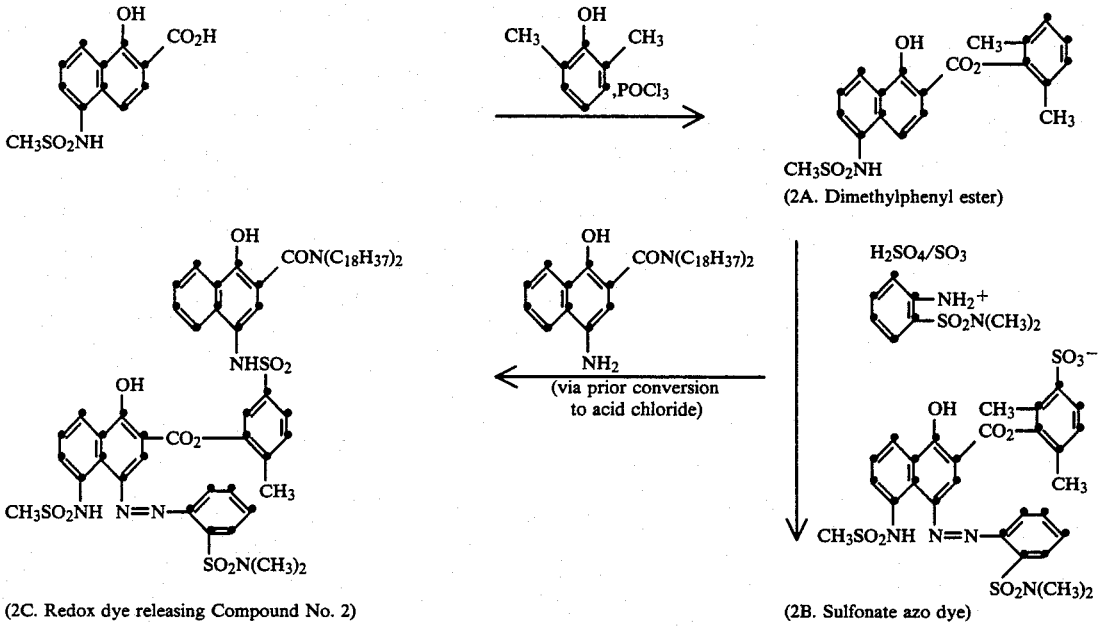

Synthesis of the dimethylphenyl ester 2A

A mixture of 5-methanesulfonamido-1-hydroxy-2-naphthoic acid (10 g, 36 mmole), 2,6-dimethoxyphenol (5.5 g, 45 mmole), and 3 ml phosphorus oxychloride in 60 ml p-dioxane were refluxed for 2 hours. The reaction mixture was poured over ice and the resulting gray solid was recovered by filtration. After trituration with hot acetone, the yield of solid ester was 11 g (80 percent).

Sulfonation and Diazotization coupling 2B

The dimethylphenyl ester 2A (5 g, 13 mmole) was reacted for 3 hours with 27–30 percent oleum (12 g) in 75 ml acetonitrile. The refluxed solution was then cooled in an ice bath and 10 ml water and 25 ml of pyridine were added and allowed to stand for 20 minutes. A second solution of 2-amino-N,N-dimethylbenzenesulfonamide (3.8 g, 19 mmole) in 40 ml methanol and 0.5 ml concentrated (36%) hydrochloric acid was diazotized at <5° C. with isoamyl nitrite (2.2 g, 19 mmole) and then added dropwise with stirring to the first solution to effect coupling. After one hour the solution was brought to room temperature and poured over ice and concentrated (36%) hydrochloric acid. The resulting solid was extracted twice with ethyl acetate, washed once with 10 percent hydrochloric acid and dried over anhydrous magnesium sulfate. Filtration and removal of the solvent gave the azo dye 2B.

Preparation of the redox dye releasing Compound No. 2

The crude dye, 2B, was dissolved in 75 ml acetonitrile and 1 ml phosphorus oxychloride was added. The mixture was warmed for 45 minutes at 50° C., poured over ice and concentrated hydrochloric acid, and the resulting red precipitate was collected by filtration. Purification was done by flash chromotography on silica gel using dichloromethane/cyclohexane/ethylacetate/acetic acid mixtures. The dye sulfonyl chloride (1.5 g, 2.2 mmole) and 4-amino-1-hydroxy-N,N-dioctadecylnaphthamide (1.7 g, 2.4 mmole) in 30 ml pyridine were stirred under nitrogen for 4 hours at room temperature. The reaction mixture was poured over ice and concentrated (36%) hydrochloric acid. The resulting solid was purified by chromatography on silica gel using acetone/dichloromethane mixtures. The yield of solid redox dye releasing Compound No. 2 was 1 g (34 percent).

SYNTHESIS 3

This example describes the preparation of Compound No. 14, a cyan sulfonamidonaphthol redox dye releasing compound derived from a methyl 4-arylazo-1-hydroxy-2-naphthoate dye linked to the carrier via a 5-sulfonamido group. A schematic representation of the reactions involved is shown below:

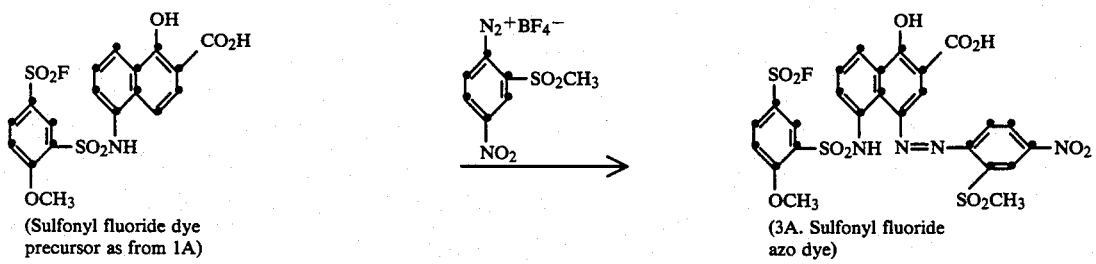

-continued

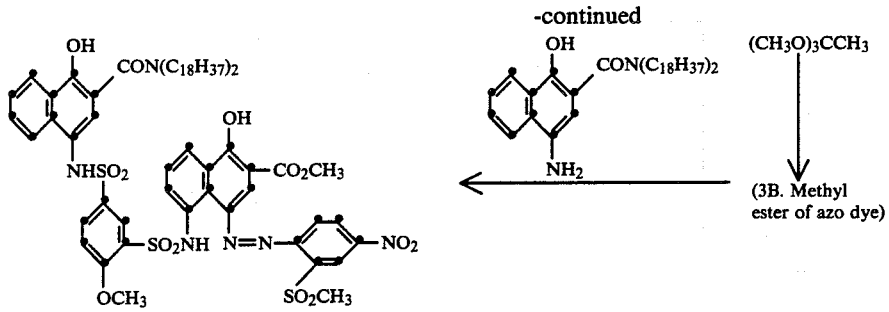

(3C. Redox dye releasing Compound No. 14)

Synthesis of the sulfonyl fluoride azo dye 3A

A solution of 5-(3-fluorosulfonyl-6-methoxybenzenesulfonamido)-1-hydroxy-2-naphthoic acid (7.5 g, 17 mmole) in 200 ml tetrahydrofuran, 25 ml glacial acetic acid, and 25 ml water was cooled in an ice bath. Solid 4-nitro-2-methylsulfonylbenzenediazonium tetrafluoroborate (7 g, 22 mmoles) was added in one gram portions until thin-layer chromatography showed no coupler remained. After 30 minutes the reaction mixture was poured over ice and concentrated (36%) hydrochloric acid. The resulting solid was extracted twice with ethyl acetate, washed once with a saturated sodium chloride solution, and dried over anhydrous magnesium sulfate. Filtration, precipitation with ligroin, and removal of solvent yielded 6.2 g (55 percent) of dye 3A.

Esterification 3B

Dye compound 3A (4 g, 5.8 mmole) was dissolved in 20 ml ethyl acetate and 5 ml trimethyl orthoacetate and refluxed for 5 minutes. The solution was cooled and washed with ether, to yield 2.4 g (59 percent) of the methyl ester, 3B.

Preparation of the redox dye releasing Compound No. 14

A mixture of 4-amino-1-hydroxy-N,N-di-octadecyl-2-naphthamide (2 g, 2.8 mmole), of methyl ester, 3B (1.9 g, 2.7 mmole), and sodium bicarbonate (350 mg, 4.2 mmole) in 30 ml dimethylsulfoxide was heated at 110° C. under nitrogen for 90 minutes. The reaction mixture was poured over ice and concentrated (36%) hydrochloric acid. The brown solid was filtered and purified by column chromatography on silica gel using selected acetone/dichloromethane mixtures. After recrystallization from methanol, a yield of 2.2 g (58 percent) of redox dye releasing Compound No. 14 was obtained.

EXAMPLE I

Table I below shows the spectral shifts that occur between the acidic or protonated form (pH<6) and the anionic form (pH>7) of magenta dye structures with various substituent groups in the 2-position of a 1-naphthol ring. Quantities of each dye, sufficient to provide densities of between 1 and 2, were dissolved in mixtures of dimethyl sulfoxide and water (4:1). The solutions were acidified with hydrochloric acid or made alkaline with triethylamine. Each solution spectrum was determined. The basic dye structure is:

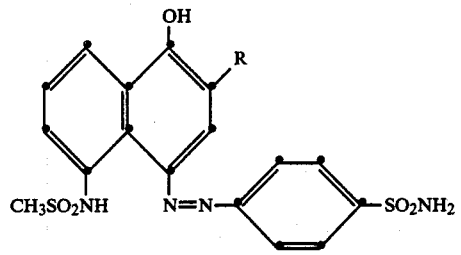

TABLE I

| R-Substituent | λ-max, nm Acidic Form | λ-max, nm Anionic Form | Δ, nm |
|---|---|---|---|
| (a) H | 472 | 564 | 92 |
| (b) $CH_3$ | 470 | 574 | 104 |
| (c) $SO_3H$ | 480 | 560 | 80 |
| (d) Cl | 492 | 570 | 78 |
| (e) $CON(CH_3)_2$ | 488 | 564 | 76 |
| (f) $SOCH_3$ | 500 | 556 | 56 |
| (g) $SO_2NH_2$ | 496 | 548 | 52 |
| (h) $SO_2CH_3$ | 508 | 538 | 30 |
| (i) $CO_2CH_3$[1] | 440 | 540 | 100 |

[1]Dye of the invention released from Compound No. 13

The first five lines of data in Table I include dyes which have substituents identified in U.S. Pat. No. 4,246,414 (H, Cl and $CON(CH_3)_2$). Each of these five substituents demonstrates the capability of imparting a hypsochromic absorption shift to a magenta dye when the dye is converted from the protonated (acidic) form to the anionic form. In the protonated form each of these five dyes appears capable of minimizing green light absorption due to its λmax value in the region below 500 nm. However, the hue of each of these five dyes, in the anionic form, is so purple that the dyes are not acceptable for use in color prints.

Table I dyes having substituents (f), (g) and (h), where both (g) and (h) are also identified in U.S. Pat. No. 4,246,414, provide desirable hue values in the anionic form. However, as shown in Table I, these three substituents are incapable of causing sufficient shifting of absorption characteristics from the anionic to the protonated form of the dye. Therefore, these dyes cannot be coated in a layer of green-sensitive silver halide emulsion without causing severe speed loss due to green light absorption by the dye compounds.

Only a carboxylic ester substituent ($CO_2CH_3$), on a dye representative of this invention (i), is shown to provide desirable absorption properties in the anionic form plus the capability of a substantial absorption shift when converted to its protonated or acidic form.

EXAMPLE 2

Table II below shows the spectral shifts that occur between the protonated and anionic forms of a series of 2-carboxylic ester dyes. As in Example 1, quantities of each dye, sufficient to provide densities of between 1 and 2, were dissolved in mixtures of dimethyl sulfoxide and water (4:1). The solutions were acidified with hydrochloric acid or made alkaline with triethylamine. Each solution spectrum was determined. The λ-max and HBW (half-band width, which is the width of the dye absorption envelope at one-half the maximum dye density) of each form were recorded from these spectra.

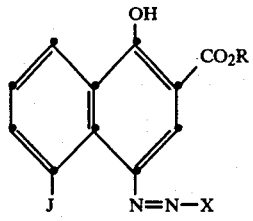

TABLE II
| Dye Released From RDR Compound No. | R | —J | X | Protonated Form λ-max, nm | Protonated Form HBW, nm | Anionic Form λ-max, nm | Anionic Form HBW, nm | Δ. λ-max, nm |
|---|---|---|---|---|---|---|---|---|
| 1 | $-CH_3$ | 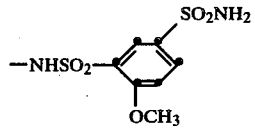 | 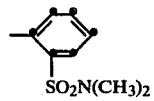 | 440 | 120* | 552 | 91 | 112 |
| 2 | 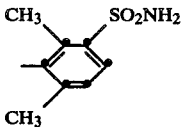 | $-NHSO_2CH_3$ | 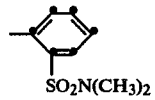 | 410** | ** | 550 | 95 | 110 |
| 3 | $-CH_3$ | $-OH$ | 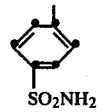 | 487 | 134 | 564 | 98 | 78 |
| 4 | $-CH_3$ | 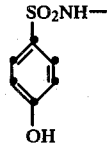 | 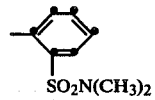 | 437 | 120* | 555 | 91 | 118 |
| 5 | $-CH_2CH_2OH$ | 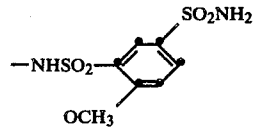 | 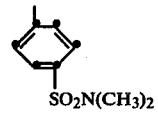 | 440 | 120* | 552 | 90 | 112 |
| 9 | 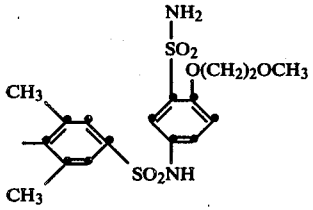 | $-NHSO_2CH_3$ | 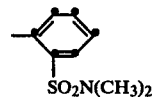 | 410** | ** | 548 | 95 | 108 |

TABLE II-continued
| Dye Released From RDR Compound No. | R | —J | X | Protonated Form λ-max, nm | Protonated Form HBW, nm | Anionic Form λ-max, nm | Anionic Form HBW, nm | Δ. λ-max, nm |
|---|---|---|---|---|---|---|---|---|
| 14 | $-CH_3$ | 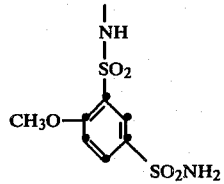 | 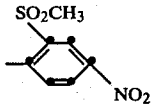 | 480** | ** | 640 | 80 | 160 |
| 15 | $-CH_3$ | 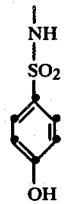 | 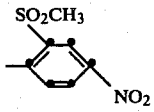 | 500 | ** | 650 | 77 | 150 |
| 16 | $-C_6H_5$ | 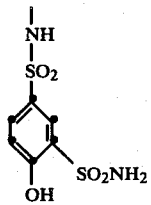 | 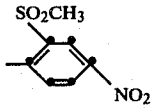 | 530** | ** | 635 | 73 | 105 |
*Curve is unsymmetrically broad
**Curve is too broad to permit accurate calculation of half-band width All of the dyes are significantly shifted from the protonated (acidic) to the anionic (basic) form. Although these shifts are generally 100 nm or more, shifts of at least 75 nm appear to offer the unique advantages of the dye-providing compounds of this invention. In some cases the spectrum of the protonated form of a dye was very broad so that the overall shift in nm was difficult to calculate. The anionic forms of all of these dyes were such that they were considered to be magenta and cyan dyes of good hue with half-bandwidths narrow enough not to have appreciable unwanted absorption.

EXAMPLE 3

Image transfer monochrome elements were prepared by coating the following layers, in the order recited, on transparent poly(ethylene terephthalate) film support. Coverages are shown in parentheses and are in g/m$^2$ unless indicated otherwise.

1. image-receiving layer of poly(styrene-co-N-benzyl-N,N-dimethyl-N-vinylbenzylammonium chloride-co-divinylbenzene) (49.5:49.5:1 weight ratio) (2.3) and gelatin (2.3);
2. reflecting layer of titanium dioxide (16) and gelatin (2.6);
3. interlayer of gelatin (1.3);
4. imaging layer of redox dye-releasing compound*, as defined in Table III, monodisperse 0.8 μm non-chemically sensitized silver bromide emulsion (0.27 Ag) and gelatin (2.7); *

The concentration of magenta RDR compounds was 0.27 mmole/m$^2$ dispersed in N,N-diethyllauramide (0.13

5. overcoat of gelatin (1.1) and bis(vinylsulfonyl) methyl ether at 1.5 percent of the total gelatin weight. mmole/m). The concentration of cyan RDR compounds was 0.18 mmole/m$^2$ dispersed in 0.09 mmole/m$^2$ of N,N-diethyllauramide.

Cover sheets were prepared by coating the following layers, in the order recited, on transparent poly(ethylene terephthalate) support:

1. acid layer: Poly(n-butyl acrylate-co-acrylic acid) (30:70 weight ratio) equivalent to 140 meq acid/m$^2$;
2. timing layer: A 1:2 physical mixture of the following two polymers (1.1 g/m$^2$): poly(acrylonitrile-co-vinylidene chloride-co-acrylic acid) (14:80:6 weight ratio) plus the carboxy ester lactone formed by cyclization of a vinyl acetate-maleic anhydride copolymer in the presence of 1-butanol to produce a partial butyl ester (ratio of acid:ester of 15:85).

A viscous processing composition was prepared containing:

| | |
|---|---|
| potassium hydroxide | 50 g/l |
| 5-methylbenzotriazole | 4 g/l |
| 4-hydroxymethyl-4-methyl-1-p-tolyl-3-pyrazolidinone | 4 g/l |
| carboxymethylcellulose | 43 g/l |

Each image transfer element was exposed to white light in a sensitometer through a graduated density test object to yield a full-scale image. Processing was done at room temperature (~21° C.) by spreading an aliquot of the processing composition between the element and the cover sheet using a pair of juxtaposed rollers to provide a fluid gap of 100 μm. After 30 minutes, the cover sheet was peeled and discarded, the element was fixed for four minutes, washed for 20 minutes and dried. The receiver side of the laminated unit was then read to obtain Status A reflection densities. The results are shown below in Table III. All of the dyes listed in Table III were released from a redox dye-releasing compound having the structural formula:

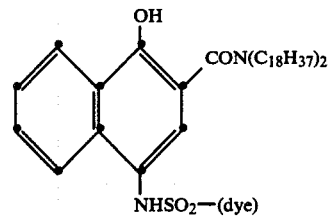

TABLE III

| Dye From Compound No. | Status A Density Color | D-max | D-min |
|---|---|---|---|
| 1 | Green | 1.3 | 0.28 |
| 2 | Green | 1.3 | 0.27 |
| 5 | Green | 1.5 | 0.15 |
| 7 | Green | 1.0 | 0.26 |
| 8 | Green | 1.0 | 0.19 |
| 9 | Green | 0.9 | 0.17 |
| 14 | Red | 1.6 | 0.51 |

The data show that dyes of this invention, released from sulfonamidonaphthol redox dye releasing compounds, are capable of providing imaging discrimination (D-max/D-min) in a diffusion transfer integral imaging-receiver format.

EXAMPLE 4

An unprocessed image transfer element prepared in Example 3 and containing the released dye from Compound No. 1 was read in a reflection densitometer from the non-mordant receiver side.

This procedure provides an evaluation of the spectrum of the preformed dye as coated (pH 5 to 6). The reflection spectrum of the released dye transferred to the mordant by photographic imaging was also determined. As the data below show, the absorption spectrum and density at λ-max of a control magenta dye in the raw stock is very similar to that of the transferred dye, whereas absorption of the dye from Compound No. 1 of this invention as coated, has been significantly shifted to shorter wavelengths.

| Dye from Compound No. | Unprocessed Coating λ-max, nm | Density | HBW, nm | After Processing λ-max, nm | Density | HBW, nm |
|---|---|---|---|---|---|---|
| Control | 540 | 1.3 | 145 | 548 | 1.6 | 131 |
| 1 | 445 | 0.9 | 149 | 556 | 1.5 | 123 |

EXAMPLE 5

This example shows the use of a cyan dye of the invention in an image transfer monochrome unit with quinone redox dye-release imaging chemistry. Image transfer elements of the structure shown below were prepared. The layers were coated, in the order recited, on transparent poly(ethylene terephthalate) film support. Coverages are in g/m$^2$ unless indicated otherwise:

1. image-receiving layer of poly(styrene-co-N-benzyl-N,N-dimethyl-N-vinylbenzylammonium chloride-co-divinylbenzene) (49.5:49.5:1 weight ratio) (2.3) and gelatin (2.3);
2. reflecting layer of titanium dioxide (19) and gelatin (1.2);

3. opaque layer of carbon (1.9) and gelatin (1.2);
4. interlayer of gelatin (0.54);
5. imaging layer of quinone redox dye-releasing compound (a) (0.39 mmole/$m^2$) and incorporated reducing agent (b) (0.84 m mole/$m^2$) codispersed in 2,4-di-t-amylphenol (0.62 mmole/$m^2$), polydisperse red-sensitive silver bromide (6 percent iodide) emulsion (1.4), inhibitor (c) (0.03) and gelatin (1.9);
6. overcoat of gelatin (0.54) and bis(vinylsulfonyl) methyl ether at 1.5 percent of the total gelatin weight.

(a) The dye released from the quinone redox dye-releasing compound was No. 14 as identified above.

(b) Incorporated reducing agent:

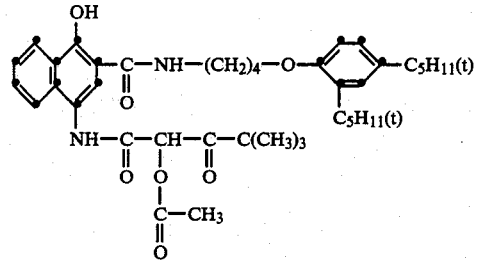

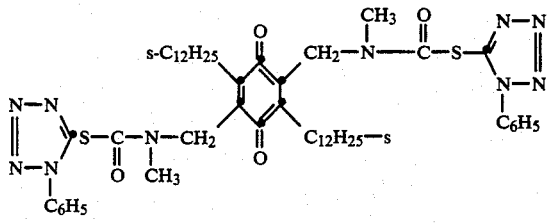

Cover sheets as described in Example 3 were prepared except that the polymer coverage for the timing layer was 4.8 g/$m^2$.

A viscous processing composition was prepared in pods and contained:

| | |
|---|---|
| potassium hydroxide | 52 g/l |
| electron transfer agent (ETA): | |
| 4-hydroxymethyl-4-methyl-1-p-tolyl-3-pyrazolidinone | 4 g/l |
| potassium bromide | 10 g/l |
| carboxymethylcellulose | 50 g/l |
| carbon | 165 g/l |
| Tamol SN ® | 2 g/l |
| lead oxide | 0.4 g/l |

The image transfer element was exposed to a white full-scale image. Processing was at room temperature (~21° C.) by spreading the contents of a pod between the element and a cover sheet using a pair of juxtaposed rollers to provide a fluid gap of 75 μm. After three hours, the receiver side of the laminated unit showed a cyan image.

This invention has been described in detail with particular reference to preferred embodiments thereof. However, it will be apparent that variations and modifications can be effected within the spirit and scope of the invention.

What is claimed is:

1. A photographic element comprising a support having thereon at least one photosensitive silver halide emulsion layer having associated therewith a nondiffusible 4-arylazo-1-napthol image dye-providing compound or precursor thereof capable of releasing a diffusible dye moiety wherein the 2-position of said napthol compound comprises a carboxylic ester substituent and the 5-position comprises sulfonamido substituent, wherein said 4-arylaxo moiety is unsubstituted or is substituted with cyano, sulfo, sulfonyl, halogen, nitro, sulfito, sulfinyl, sulfamoyl, carbamoyl, alkyl, alkoxy or mercapto, and wherein said compound is capable of a reversible hypsochromic absorption shift from the protonated form to the anionic form thereof.

2. The photographic element according to claim 1 wherein said nondiffusible compound is represented by the structural formula:

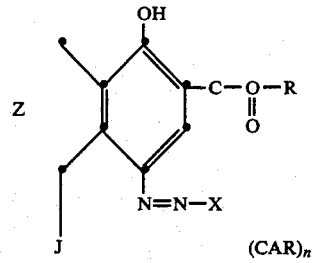

where

Z represents the carbon atoms necessary to complete an unsubstituted or a substituted naphthol ring;

R is an unsubstituted or a substituted, straight or branched chain alkyl group having from 1 to about 12 carbon atoms or an unsubstituted or a substituted aryl group having from 6 to 15 carbon atoms;

J is $—NHSO_2R^1$;

$R^1$ is a straight or a branched chain alkyl group having from 1 to 6 carbon atoms or an aryl group having from 6 to 10 carbon atoms;

X represents an unsubstituted aryl moiety or an aryl moiety substituted with cyano, sulfo, sulfonyl, halogen, nitro, sulfito, sulfinyl, sulfamoyl, carbamoyl, alkyl, alkoxy or mercapto;

CAR represents a ballasted carrier moiety capable of releasing the diffusible dye moiety as a function of development of silver halide under alkaline conditions; and n is a positive integer of 1, 2 or 3.

3. The photographic element of claim 2 wherein R is an alkyl group having from 1 to about 4 carbon atoms or a phenyl group containing a solubilizing substituent.

4. The photographic element of claim 3 wherein said substituent is a sulfamoyl or a carbamoyl group.

5. The photographic element of claim 2 wherein n is 1 and CAR is attached to J or to R.

6. The photographic element of claim 5 wherein R is a phenyl group.

7. The photographic element of claim 6 wherein R is a dialkylsubstituted phenyl group.

8. The photographic element according to claim 2 wherein the naphthol ring completed by Z contains an electron withdrawing or an electron donating substituent.

9. The photographic element of claim 2 wherein CAR is a group having the formula:

(Ballast—Carrier—Link)— wherein:

(a) Ballast is an organic ballasting radical of such molecular size and configuration as to render said dye-providing compound nondiffusible in said photographic element during development in an alkaline processing composition, (b) Carrier is an oxidizable acyclic, carbocyclic or heterocyclic moiety, and (c) Link represents a group which, upon oxidation of said carrier moiety, is capable of being hydrolytically cleaved to release said diffusible dye moiety.

10. The photographic element of claim 9 wherein said carrier moiety contains atoms according to the following configuration:

$$a-(-C{=}C)_b-$$

where: a represents the radicals OH, SH, NH—, or hydrolyzable precursors thereof and b is a positive integer of 1 or 2.

11. The photographic element of claim 2 wherein CAR is a group having the formula:

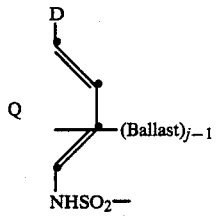

wherein:

(a) Ballast is an organic ballasting radical of such molecular size and configuration as to render said dye-providing compound nondiffusible in said photographic element during development in an alkaline processing composition, (b) D is $OR^6$ or $NHR^7$ wherein $R^6$ is hydrogen or a hydrolyzable moiety and $R^7$ is hydrogen or a substituted or unsubstituted alkyl group of 1 to about 22 carbon atoms, (c) Q represents the atoms necessary to complete a benzene nucleus, a naphthalene nucleus, or a 5 to 7 membered heterocyclic ring, and (d) j is a positive integer of 1 or 2 and is 2 when D is $OR^6$ or when $R^7$ is hydrogen or an alkyl group of less than 8 carbon atoms.

12. The photographic element of claim 14 wherein D is OH, j is 2 and Q is a naphthalene nucleus.

13. The photographic element of claim 2 wherein said nondiffusible compound is:

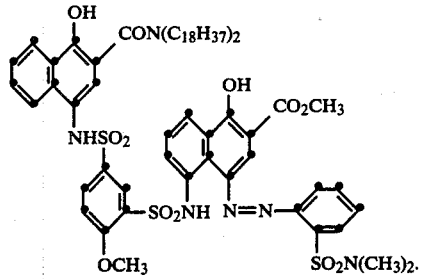

14. The photographic element of claim 2 wherein said nondiffusible compound is:

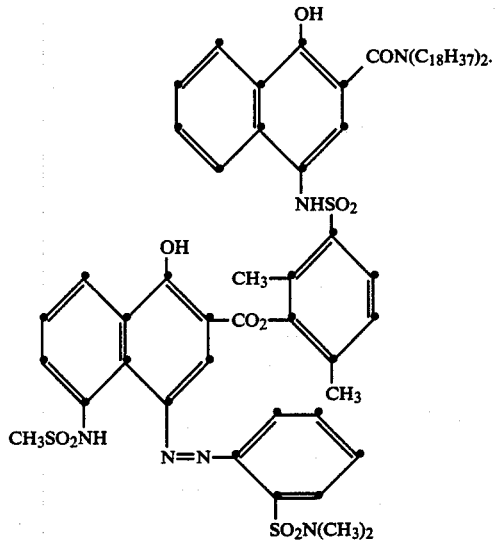

15. The photographic element of claim 2 wherein said nondiffusible compound is:

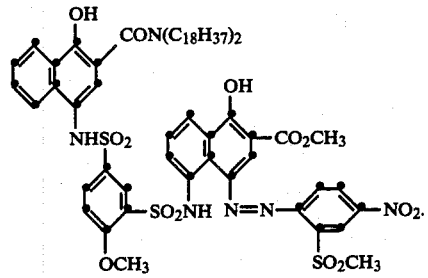

16. A photographic assemblage comprising:

(a) a photographic element according to any of claims 1 to 8 and 12 to 18;

(b) a dye image-receiving layer; and (c) an alkaline processing composition with means for discharging same within said assemblage;

said assemblage also comprising a silver halide developing agent.

* * * * *